US008939191B2

(12) United States Patent
Arzberger et al.

(10) Patent No.: US 8,939,191 B2
(45) Date of Patent: Jan. 27, 2015

(54) TEMPERATURE MEASUREMENT IN A CHILL MOLD BY A FIBER OPTIC MEASUREMENT METHOD

(75) Inventors: Matthias Arzberger, Mülheim a. d. Ruhr (DE); Dirk Lieftucht, Ledgen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/003,344

(22) PCT Filed: Jul. 7, 2009

(86) PCT No.: PCT/EP2009/004901

§ 371 (c)(1),
(2), (4) Date: Feb. 23, 2011

(87) PCT Pub. No.: WO2010/003632

PCT Pub. Date: Jan. 14, 2010

(65) Prior Publication Data

US 2011/0139392 A1 Jun. 16, 2011

(30) Foreign Application Priority Data

Jul. 10, 2008 (DE) ..... 10 2008 032 341
Dec. 4, 2008 (DE) ..... 10 2008 060 507

(51) Int. Cl.
*B22D 2/00* (2006.01)
*B22D 46/00* (2006.01)
(Continued)

(52) U.S. Cl.
CPC ..... *B22D 2/006* (2013.01); *B22D 11/182* (2013.01); *B22D 11/202* (2013.01)
USPC ..... 164/4.1; 164/151.4

(58) Field of Classification Search
CPC .... B22D 2/006; B22D 11/182; B22D 11/202; B22D 46/00
USPC ..... 164/4.1, 151.4
See application file for complete search history.

(56) References Cited

U.S. PATENT DOCUMENTS 4,056,377 A * 11/1977 Auracher ..... 65/401
4,075,890 A 2/1978 Iwasaki et al.
(Continued)

FOREIGN PATENT DOCUMENTS

DE 45370 5/1888
DE 2655640 10/1977
(Continued)

OTHER PUBLICATIONS

Optimum Safety in Tunnels and Special Hazard Buildings.
(Continued)

*Primary Examiner* — Kevin P Kerns
(74) *Attorney, Agent, or Firm* — Lucas & Mercanti, LLP; Klaus P. Stoffel

(57) ABSTRACT

A method for measuring the temperature in a mold by a fiber-optic measurement method and a correspondingly designed mold. For this purpose, light waveguides, through which laser light is conducted, are arranged in grooves in the outside surface of the copper mold plate. The temperature at several measurement points along the measurement fiber is determined by a temperature detection system. In particular, the method makes it possible to achieve much greater local resolution of the temperature measurements than that achieved by thermocouples.

11 Claims, 4 Drawing Sheets

(51) Int. Cl.
*B22D 11/18* (2006.01)
*B22D 11/20* (2006.01)

(56) References Cited

U.S. PATENT DOCUMENTS

| | | | | |
|---|---|---|---|---|
| 4,553,604 | A | 11/1985 | Yaji et al. | |
| 4,911,523 | A | 3/1990 | Sondergeld et al. | |
| 5,730,527 | A * | 3/1998 | Takayama et al. | 374/131 |
| 7,043,404 | B2 | 5/2006 | Arzberger et al. | |
| 2003/0150584 | A1 | 8/2003 | Adamy et al. | |
| 2008/0095612 | A1 | 4/2008 | Girbig et al. | |
| 2010/0000704 | A1 | 1/2010 | Streubel et al. | |

FOREIGN PATENT DOCUMENTS

| | | | | |
|---|---|---|---|---|
| DE | 34 36 331 A1 * | 4/1986 | | B22D 11/04 |
| DE | 3436331 | 4/1986 | | |
| DE | 10236033 | 2/2004 | | |
| DE | 102006036708 Y | 2/2008 | | |
| DE | 102006037728 Y | 2/2008 | | |
| EP | 0101521 | 2/1984 | | |
| EP | 0305832 | 3/1989 | | |
| EP | 1060046 | 7/2002 | | |
| EP | 1289692 | 3/2003 | | |
| JP | 1094306 | 4/1989 | | |
| JP | 8145810 | 6/1996 | | |
| JP | 9-47855 A * | 2/1997 | | B22D 11/16 |
| JP | 09047855 | 2/1997 | | |
| RU | 2015821 | 7/1994 | | |
| WO | 2004082869 | 9/2004 | | |
| WO | 2005106209 | 11/2005 | | |
| WO | 2006000334 | 1/2006 | | |
| WO | 2008017374 | 2/2008 | | |
| WO | 2008017402 | 2/2008 | | |

OTHER PUBLICATIONS

Prozessgeeignete Temperaturprofil-Messungen Mit Faseroptischen Methoden.
Faseroptische Temperatemessung.

* cited by examiner

TEMPERATURE MEASUREMENT IN A CHILL MOLD BY A FIBER OPTIC MEASUREMENT METHOD

The present application is a 371 of International application PCT/EP2009/004901 filed Jul. 7, 2009, which claims priority of DE 10 2008 032 341.1, filed Jul. 10, 2008 and DE 10 2008 060 507.7, filed Dec. 4, 2008, the priority of these applications is hereby claimed and these applications are incorporated herein by reference.

BACKGROUND OF THE INVENTION

The invention pertains to a method for measuring the temperature in a mold by means of a fiber-optic measuring method and to a correspondingly designed mold. For this purpose, light waveguides, through which laser light is conducted, are provided on the outside surface of a mold. The invention serves to improve the local resolution of the temperature detection in a mold in comparison with the known temperature detection systems and makes it possible in particular to improve the detection of longitudinal cracks and fractures.

PRIOR ART

Temperature detection in a mold is a critical problem, which is becoming even more important in the case of casting machines operating at high speed. In most cases, temperatures in the mold are detected primarily by thermocouples, which are either guided through bores in the copper plate of the mold or welded onto the copper plates of the mold. Such measurement methods are based on the evaluation of thermal stresses. The number and size of these thermocouples is limited. In many cases, the only way to avoid the great expense of reconstructing the entire mold is to install the thermocouples only where the necked-down bolts are located. Increasing the number of thermocouples, furthermore, leads to a very large amount of cabling work. These sensors are also susceptible to the electromagnetic fields caused by electromagnetic brakes or stirrers, for example. To protect the thermocouples, including their cabling, it is also necessary to provide complicated protective devices. When the copper plates of a mold are to be replaced—a task which must be done at regular intervals—the thermocouples must be disconnected and then reconnected to their cables, which not only requires a great deal of work but also involves the danger of making wrong connections.

WO 2004/082869 describes a method for determining the temperature in a continuous casting mold by the use of thermocouples, which are arranged on a copper plate outside the mold and which project into the mold through bores.

DE 3436331 describes a similar method for measuring temperatures in metallurgical vessels, especially in continuous casting molds, in which large numbers of thermocouples are arranged in transverse bores.

These two methods suffer from the disadvantages cited above. In addition, producing a large number of bores is expensive and time-consuming. A very large number of thermocouples installed in this way results unfortunately in an extremely large amount of cabling work.

From JP 09047855 is known a method for predicting breakout in continuous casting, in which an optical fiber is arranged on the hot side of the mold in an embedded or exposed manner in a serpentine fashion. This arrangement is found in the direction of the width on the hot side of the mold.

DE 102 36 033, which pertains to the monitoring of refractory linings of melting furnaces, especially induction furnaces, describes a temperature measuring method-using optical fibers, wherein optical fibers are attached to lining material behind several layers of insulation and used for fiber-optic backscatter measurement. In this form, however, such systems are unsuitable for measuring temperatures in a mold and are not designed for the exact detection of local temperatures in a casting mold.

SUMMARY OF THE INVENTION

The technical problem which therefore arises is to find an improved method for measuring temperatures in a mold, especially for measuring them with greater local resolution, namely, a method which requires the least possible amount of installation work and which improves, among other things, the detection of longitudinal cracks and/or through-fractures in the mold.

The technical problem explained above is solved by the invention disclosed below. In particular, the invention provides a method for measuring temperatures in a mold of a casting machine, wherein sensors for measuring the temperature in at least one copper plate of the mold are used, these sensors being connected to a temperature detection system, characterized in that at least one light waveguide fiber, through which laser light is conducted, is used as a sensor, wherein grooves, in which the at least one light waveguide fiber is arranged, are formed in the outside surface of the copper mold plate.

Temperature detection by means of optical fibers makes it possible to achieve a significant reduction in the amount of cabling work in comparison with the use of thermocouples in the mold. In addition, much less work and much lower cost are required to install the fibers in the copper plate of the mold. The use of light waveguides according to the above method also makes it possible to achieve much greater local resolution than temperature measurement by the previously described systems based on the use of thermocouples in bores. One glass fiber line, for example, can replace more than a hundred thermocouples with their cabling. Nor is there any need for complicated devices to protect the thermocouples and their cabling.

In another preferred form, the method comprises at least one light waveguide fiber, which is arranged in meander fashion in the grooves on the outside surface of the mold's copper plate.

In another preferred embodiment, the method comprises at least two light waveguide fibers, longitudinally offset from each other, each of which is arranged in a groove. The local resolution of the temperature measurement can be improved even more by this means.

In another preferred embodiment, the method comprises grooves between cooling channels, which are arranged on the outside surface of the mold's copper plate.

In another preferred embodiment, the method comprises light waveguide fibers, which are arranged in the fixed side, in the loose side, and preferably in both of the two narrow sides of the mold.

In another preferred embodiment, the light waveguide of each individual side is connected to the temperature detection system by a coupler and by an additional, separate light waveguide.

In another preferred embodiment, the light waveguides of the individual sides are connected to each other in series by couplers and are connected to the temperature detection system by another coupler.

In another preferred embodiment of the method, the laser light is guided to the mold by at least one coupler, through which the channels of several light waveguide fibers are transmitted simultaneously.

In another preferred embodiment of the method, the couplers are lens couplers.

In another preferred embodiment of the method, the data of the temperature detection system are transmitted to a process computer, which processes these data and controls the casting operation accordingly.

The invention also consists of a mold for the casting of metal, which comprises at least one copper plate and which is characterized in that grooves, in which light waveguide fibers for temperature measurement are arranged, are provided on the outside surface of the mold's copper plate.

In another preferred embodiment of the mold, the light waveguide fibers are arranged in meander fashion in the grooves.

In another preferred embodiment of the mold, at least two light waveguide fibers, which are longitudinally offset from each other, are provided, and each of which is arranged in its own groove.

In another preferred embodiment of the mold, the grooves are arranged between cooling channels located on the outside surface of the mold's copper plate.

DETAILED DESCRIPTION OF THE INVENTION

Figure 1:
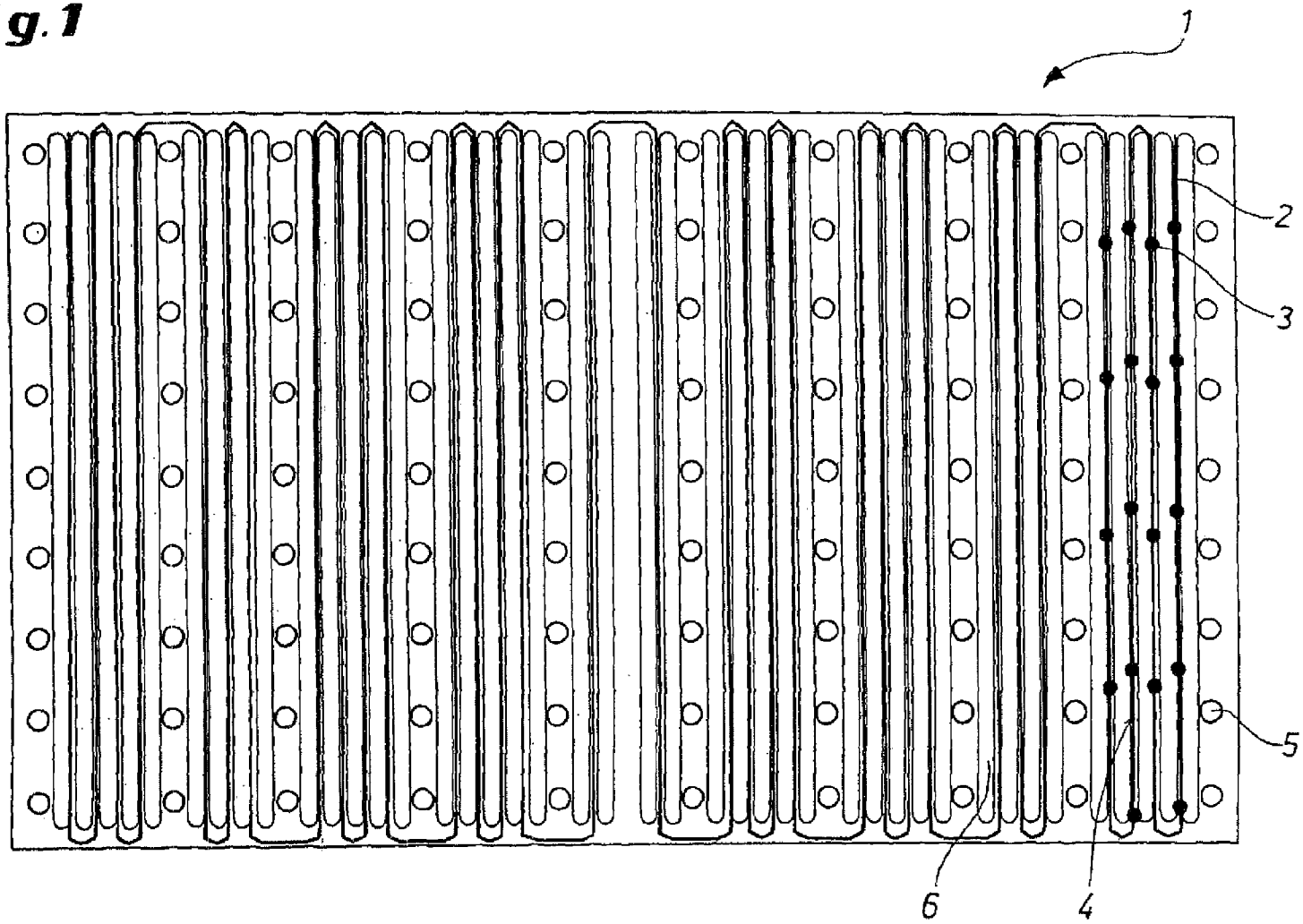
FIG. 1 shows a two-dimensional schematic view of the outside surface of a copper plate of a mold with grooves, in which optical fibers are arranged.

FIG. 1 shows an exemplary embodiment of the invention, in which a light waveguide fiber 2 is laid in meander fashion in grooves 4 between the cooling channels 6 on the rear surface of a copper plate 1 of a mold. In this exemplary embodiment, a light waveguide 2 containing only a few measuring sites 3 has been selected so that diagram can be understood more easily. Many more measuring sites 3 than this, of course, could also be provided. Necked-down bolts 5, in which thermocouples, for example, were or can be arranged, are also visible in this exemplary embodiment. In this exemplary embodiment, it can be seen that the resolution perpendicular to the casting direction is a multiple—perhaps double the resolution—of that obtainable with thermocouples installed exclusively in the necked-down bolts 5. As a result of this advantageous arrangement and use of light waveguide fibers 2, the occurrence of longitudinal cracks in particular can be monitored more effectively. Under certain conditions, this improvement of the resolution can be crucial, because the distance between adjacent necked-down bolts 5 is usually greater than the temperature detection radius of the thermocouples. Thus, in the case of an arrangement consisting exclusively of thermocouples in the necked-down bolts 5, there will be areas in the copper plate which cannot be monitored by the thermocouples. The arrangement of the optical fibers 2, as shown in FIG. 1, overcomes this problem and guarantees that the temperature in the copper plate of the mold 1 will be monitored over the entire surface.

Independently of this exemplary embodiment, it is possible, for example, to embed the light waveguide fibers 2 in the grooves 4 by means of a casting resin, but they could also be held in place in the grooves 4 by some other conventional method.

It is also possible for the light waveguide fibers 2 to have a high-grade steel jacket to protect them more effectively from external influences. In general, several of these optical fibers 2 can be arranged inside a high-grade steel jacket or high-grade steel sheath, so that, if one of the fibers 2 should prove defective—which happens rarely—another fiber 2, which is already present in the sheath, can take over. It is also conceivable that several fibers 2 arranged inside a sheath could be used for measurement purposes simultaneously, as a result of which the measurements acquire even greater accuracy, because now the measuring sites 3 can be arranged as close together as desired.

The light waveguide fibers 2 can preferably have a diameter of 0.1-0.2 mm or some other conventional diameter. The diameter of a sheath of high-grade steel, for example, can vary in the range of 0.5-6 mm. The diameter of the grooves 4 can be preferably in the range of 1-10 mm or can even be as large as several cm, depending on the application.

For the purpose of improving the local resolution, it is also possible to arrange several light waveguide fibers within a single groove 4. As a result, the number of measuring sites 3 can be significantly increased. Thus the resolution in the direction of the cooling channels 6, that is, in the casting direction, can increased by any desired factor in comparison with that shown in the figure; for example, it can be doubled or quadrupled.

In general, it is possible to replace 60-120 thermocouples together with their cabling through the use of one or two glass fiber lines or light waveguide fibers. The number of measurement sites is limited in principle only by the computing capacity of the selected temperature detection system 10. It is therefore possible, with a corresponding temperature detection system 10, to increase the number of measuring sites significantly, so that more than 500 measuring sites can be realized per optical fiber 2. As a result of this much denser measurement site number, the local resolution can be multiplied even more.

Figure 2:
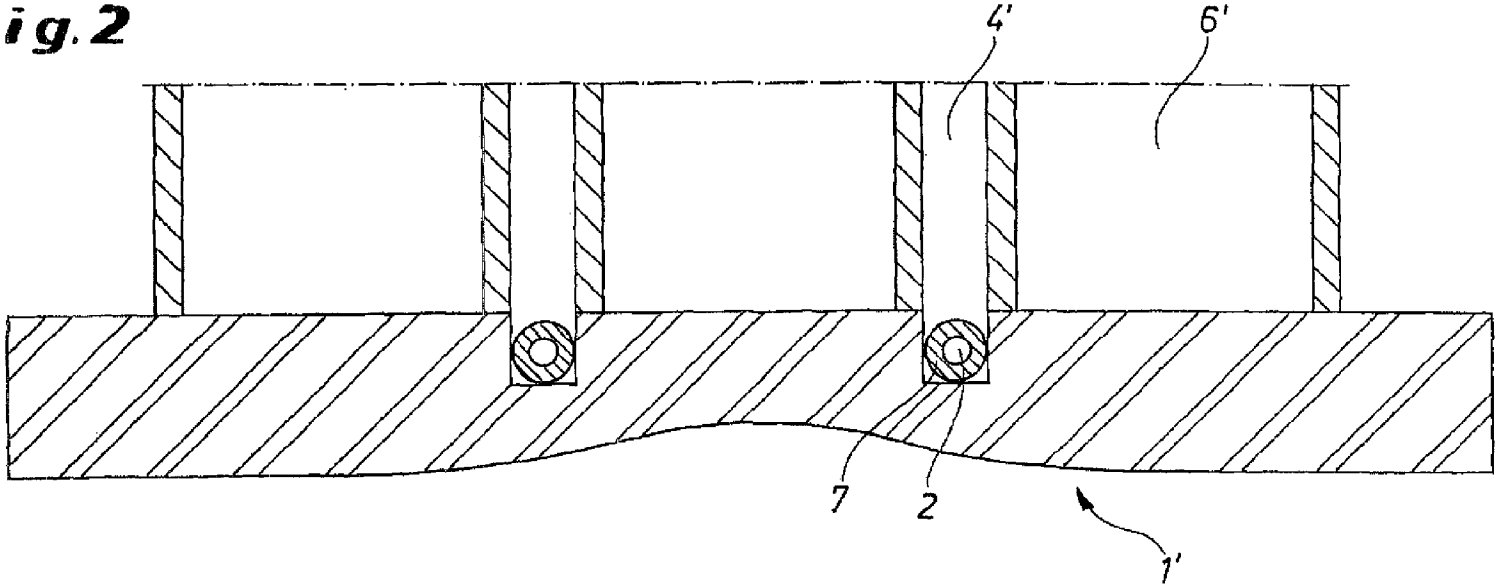
FIG. 2 shows a cross section through the wide side of a mold with cooling slots and the optical fibers arranged between the cooling slots. The highly simplified diagram does not show the correct size relationships.

FIG. 2 shows a cross section through a copper plate 1' on the wide side of a mold according to another exemplary embodiment of the invention. The inside surface of the mold can be seen in the lower part of the figure. On the outside surface of the mold's copper plate 1' (above) are cooling channels 6', between which slots or grooves 4' are located, in which light waveguides 2 are arranged in contact with the mold's copper plate. The light waveguides 2 in this exemplary embodiment have a high-grade steel jacket 7, but they can also be installed in the system without jacketing. In addition, several light waveguides or light waveguide fibers 2 can be arranged inside one of these jackets 7. In this exemplary embodiment, furthermore, the light waveguides 2 are preferably embedded in the grooves 4' with a casting resin. The diagram of FIG. 2 does not show the real size relationships between the grooves 4', the cooling channels 6', the light waveguides 2, and the copper plate 1'. The dimensions of the grooves 4', of the light waveguides 2, and of the cooling channels 6' depend on the specific mold being used and can be on the same order of magnitude as those cited in the description of FIG. 1.

Figure 3:
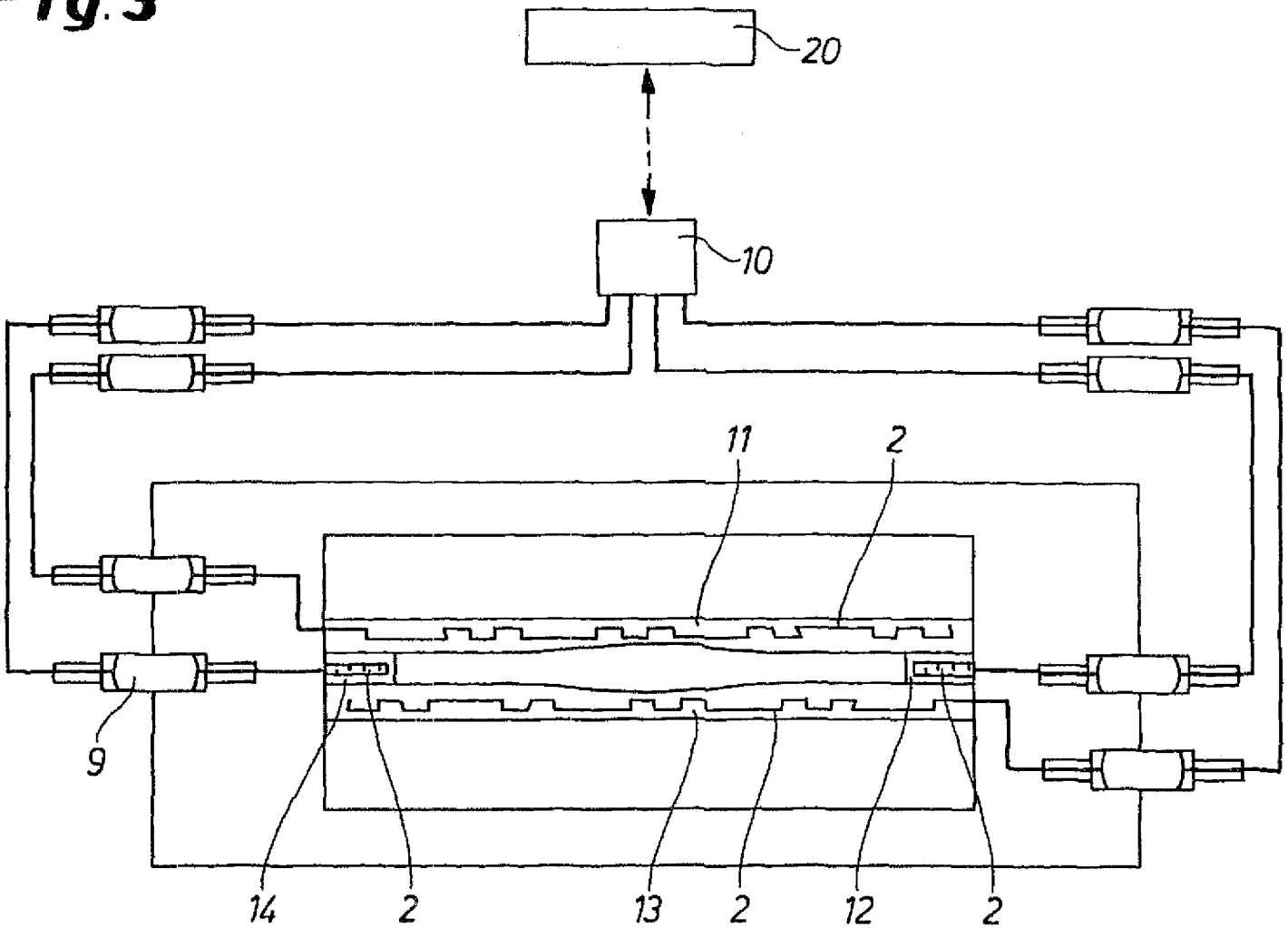
FIG. 3 shows a diagram of the arrangement of light waveguides in the various sides of a mold and of their connection to a temperature detection unit and a process computer.

FIG. 3 shows by way of example a circuit diagram of the light waveguide 2 and its connection to the temperature detection system 10. In this exemplary embodiment, light waveguide fibers 2 are arranged in the fixed side 11, in the loose side 13, and in the two narrow sides 12, 14 of the mold. These light waveguides of the individual sides are connected to the detection system 10 by light waveguide cables or additional light waveguides. To connect each of the individual light waveguide fibers 2 to the temperature detection system 10, so-called lens couplers 9 are provided. It is also possible, if desired, to provide a much larger number of lens couplers (or none at all) between the evaluation unit and the fibers in the mold; this has no significant influence on the quality of the signal. It is also possible to provide several fibers 2 on each side of the mold 11, 12, 13, 14 and to connect these, too, to the temperature detection system 10. It is also possible, furthermore, to detect temperatures on only one, on only two, or on only three sides 11, 12, 13, 14 of the mold.

The temperature detection system 10 is connected to a process computer 20. The laser light which is fed into the light waveguide 2 is generated by this temperature detection system 10 or optionally also with the help of an additional external system. The data collected by the light waveguide fibers 2 are converted into temperatures by the temperature detection system and assigned to the various locations on the mold. The evaluation can be accomplished by means of, for example, the known fiber-Bragg-grating method (FBG method). In this method, suitable light waveguides, into which measurement sites are inscribed by periodic variation of the index of refraction, and/or gratings with such variations are used. This periodic variation of the index of refraction leads to the ability of the light waveguide to act, as a function of the periodicity, as a dielectric mirror for certain wavelengths at the measurement site. A change in the temperature at a certain point on the mold has the effect of changing the Bragg wavelength, wherein precisely the light of this wavelength is reflected. Light which does not fulfill the Bragg condition is not significantly affected by the Bragg grating. The various signals of the different measurement sites can then be differentiated from each other on the basis of the differences in their transit times. The detailed design of such fiber Bragg gratings and the corresponding evaluation systems are generally known. The accuracy of the local resolution is determined by the number of inscribed measurement sites. The size of a measurement site can be in the range of, for example, 1-5 mm.

Alternative methods which can be used to measure the temperatures include "optical frequency domain reflectometry" (OFDR) and "optical time domain reflectometry" (OTDR). These two methods are based on the principle of fiber-optic Raman backscattering, wherein the phenomenon that a temperature change at a certain point of an optical fiber results in a change in the Raman backscattering of the light waveguide material is exploited. With the help of an evaluation unit such as a Raman reflectometer, it is then possible to determine the locally resolved temperature values along a fiber, wherein, in this method, a mean value over a certain length of the conductor is determined. This length is currently a few centimeters. The various measurement sites are again distinguished from each other on the basis of the differences in their transit times. The design of such evaluation systems according to the previously mentioned methods is generally known, as is the design of the lasers required to generate the laser light sent through the fibers 2.

The locally resolved temperature data acquired by the temperature detection unit 10 are then sent on preferably to a process computer 20, which can control the casting parameters such as the casting speed or the cooling and/or other standard parameters as a function of the temperature distribution in the mold.

Figure 4:
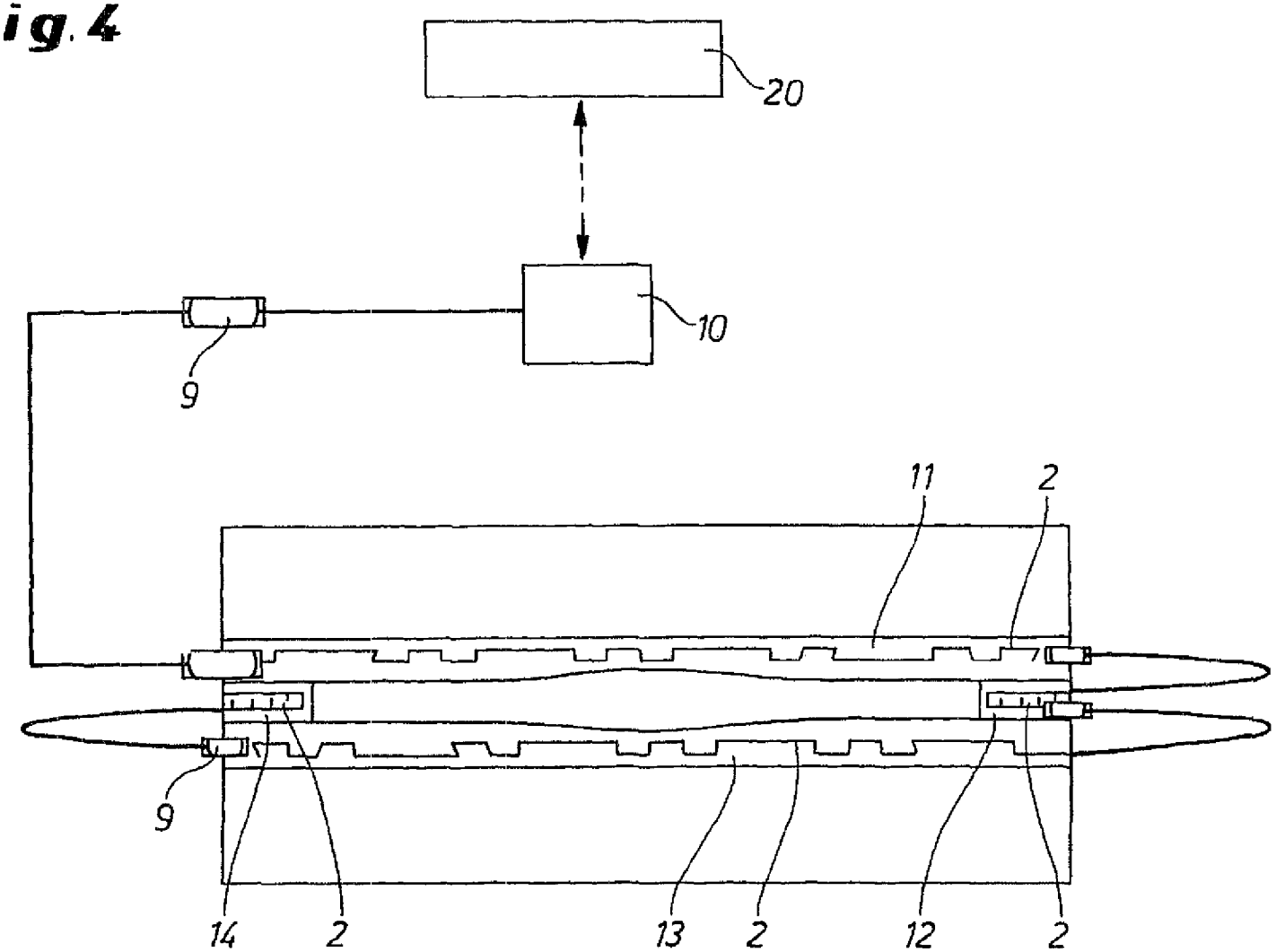
FIG. 4 shows another diagram of the arrangement of the light waveguides in the various sides of a mold, of their connection to each other in series, and of the connection of the series-connected light waveguides to a temperature detection unit and a process computer.

FIG. 4 shows a schematic circuit diagram of an arrangement of light waveguide fibers 2 in the side walls of a mold. In contrast to FIG. 3, however, the light waveguides 2 in the individual side walls of the mold are now connected to each other in series. That means, in this case, a light waveguide fiber 2 of the first narrow side 12 is connected to a light waveguide fiber 2 of the loose side 13 by a lens coupler 9; the light waveguide fiber 2 of the loose side 13 is connected to a light waveguide fiber 2 of the second narrow side 14 by a lens coupler 9; the light waveguide fiber 2 of the second narrow side 14 is connected to a light waveguide fiber 2 of the fixed side 11 by a lens coupler 9; and the light waveguide fiber 2 of the fixed side 11 is connected to the temperature detection system 10 by a lens coupler 9. It is clear that the sequence of sensors of the four sides, if desired, can also be changed in any suitable way. As a result of this type of series circuit, the cabling work is again significantly reduced. It is also possible to install several fibers 2 in each side 11, 12, 13, 14 of the mold and to connect these also in series. It is also possible, furthermore, to provide temperature detection on only one side, on only two sides, or on only three sides 11, 12, 13, 14 of the mold.

Either the FGB method, the OTDR method, or the OFDR method can be used for evaluation, as in the case of FIG. 3. In addition, it is also possible in general to use any other suitable method to determine the change in temperature along the fibers.

Figure 5:
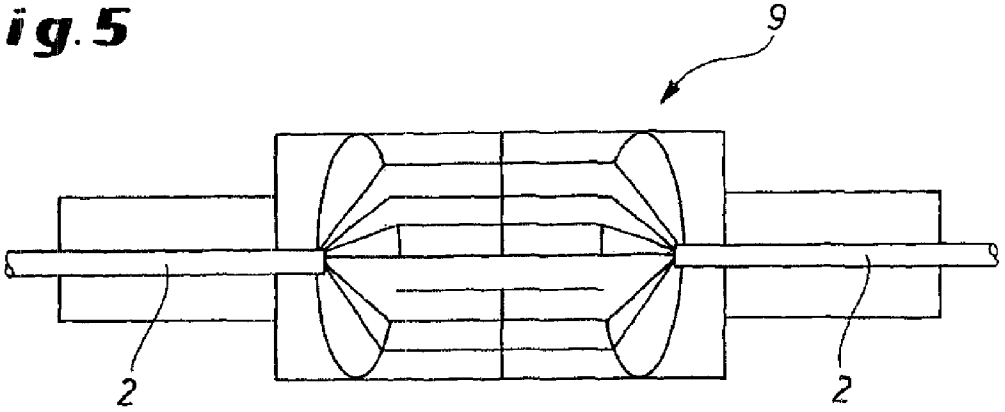
FIG. 5 shows a schematic cross section through a lens coupler.

FIG. 5 shows by way of example a cross section through a lens coupler 9 such as that shown in FIGS. 3 and 4. The coupler 9 consists of two halves, one end of each of which is connected to a light waveguide 2. These couplers have an internal lens system, in which the light beam to be transmitted is fanned out at one end and then bundled back again at the other end of the coupler. Between the two halves of the coupler, the beam is kept parallel. Several light waveguide channels can be transmitted simultaneously through a coupler of this type. The lens couplers can also be designed in the form of so-called "outdoor EBC" plugs ("Extended Beam Connectors"). These couplers are very sturdy and insensitive to contamination.

LIST OF REFERENCE NUMBERS

1, 1' copper plate of a mold
2 light waveguide fiber
3 measurement site
4, 4' groove
5 necked-down bolt
6, 6' cooling channel
9 lens coupler
10 temperature detection system
11 fixed side
12 first narrow side
13 loose side
14 second narrow side
20 process computer

The invention claimed is:

1. A method for measuring temperatures in a mold of a casting machine, the mold having an inside surface exposed to molten metal and an oppositely directed outside surface not exposed to molten metal, the method comprising the steps of:

measuring the temperature in at least one copper plate of the mold with sensors connected to a temperature detection system, wherein at least one light waveguide fiber, through which laser light is conducted, is used as a sensor;

arranging grooves parallel to and between cooling channels on the outside surface not exposed to molten metal of the mold's copper plate, wherein each groove portion is arranged parallel to each portion of the cooling channel; and arranging the at least one light waveguide fiber in a high-grade steel mantel in the grooves in a serpentine manner without intersecting.

2. The method according to claim 1, including arranging each of at least two longitudinally offset light waveguide fibers in its own groove.

3. The method according to claim 1, including arranging the light waveguide fibers in a fixed side, in a loose side, and in each of two narrow sides of the mold.

4. The method according to claim 3, including connecting the light waveguide of each individual side of the mold to the temperature detection system by its own coupler and by an additional separate light waveguide.

5. The method according to claim 4, wherein the couplers are lens couplers.

6. The method according to claim 3, including connecting the light waveguides of the individual sides of the mold to each other in series by couplers, and connecting the waveguides to the temperature detection system by another coupler.

7. The method according to claim 1, including guiding the laser light to the mold by at least one coupler, through which signals of several light waveguide fibers are transmitted simultaneously.

8. The method according to claim 1, further including transmitting data of the temperature detection system to a process computer that processes the data and controls the casting operation accordingly.

9. A mold for casting of metal, comprising:

at least one copper mold plate having an inside surface exposed to molten metal, an oppositely directed outside surface not exposed to molten metal, and grooves provided on the outside surface of the copper mold plate so as to be parallel to and between cooling channels on the outside surface, wherein each groove portion is arranged parallel to each portion of the cooling channel; and light waveguide fibers for temperature measurement arranged in the grooves in a serpentine manner without intersecting.

10. The mold according to claim 9, wherein the light waveguide fibers are longitudinally offset, and each of at least two of the longitudinally offset light waveguide fibers is arranged in its own groove.

11. The mold according to claim 9, wherein the grooves are arranged between cooling channels on the outside surface of the copper mold plate.

* * * * *